US005701692A

United States Patent [19]

Woodall

[11] Patent Number: 5,701,692

[45] Date of Patent: Dec. 30, 1997

[54] CONTAINMENT WALL INSTALLATION PROCESS AND APPARATUS

[75] Inventor: Weldon Woodall, Jacksonville, Fla.

[73] Assignee: Groundwater Control, Inc., Jacksonville, Fla.

[21] Appl. No.: 675,060

[22] Filed: Jul. 3, 1996

[51] Int. Cl.[6] ..... E02F 5/10

[52] U.S. Cl. ..... 37/353; 37/142.5; 405/128; 405/176

[58] Field of Search ..... 37/142.5, 353, 37/DIG. 18; 61/72.6, 72.4; 404/100, 102, 113, 114; 405/174, 175, 176, 177, 182, 180, 183, 128

[56] References Cited

U.S. PATENT DOCUMENTS

| | | | |
|---|---|---|---|
| 3,603,097 | 9/1971 | Zackiewicz . | |
| 3,874,175 | 4/1975 | Winters | 405/128 |
| 3,874,182 | 4/1975 | Potter et al. . | |
| 3,893,302 | 7/1975 | Peterson . | |
| 3,927,536 | 12/1975 | Sprenkel . | |
| 3,978,673 | 9/1976 | Schleede | 405/128 |
| 4,028,902 | 6/1977 | Courson et al. . | |
| 4,289,424 | 9/1981 | Shefbuch et al. . | |
| 4,543,016 | 9/1985 | Tallard . | |
| 4,597,693 | 7/1986 | McQuary et al. . | |
| 4,714,381 | 12/1987 | Hatch . | |
| 4,720,212 | 1/1988 | Steenbergen et al. . | |
| 4,793,728 | 12/1988 | Ellis . | |
| 4,806,043 | 2/1989 | Fournier . | |
| 4,812,078 | 3/1989 | Rivard . | |
| 4,863,312 | 9/1989 | Cavalli . | |
| 4,871,281 | 10/1989 | Justice . | |
| 4,927,293 | 5/1990 | Campbell | 405/128 |
| 4,929,126 | 5/1990 | Steenbergen et al. . | |
| 5,112,161 | 5/1992 | Trevisani . | |
| 5,118,230 | 6/1992 | Justice . | |
| 5,174,685 | 12/1992 | Buchanan . | |
| 5,392,540 | 2/1995 | Cooper et al. . | |

OTHER PUBLICATIONS

Groundwater Control Inc.—"Unique Gundwall Installation Developed Through Team Effort"—Trench Topics—Mailed Jul. 6, 1995—vol. 1, Issue 2.

*Primary Examiner*—Terry Lee Melius
*Assistant Examiner*—Robert Pezzuto
*Attorney, Agent, or Firm*—Cushman Darby & Cushman Intellectual Property Group of Pillsbury Madison & Sutro, LLP

[57] ABSTRACT

A method of installing a groundwater containment system is provided utilizing a powered trenching apparatus. The apparatus includes a boom at an end thereof; a trenching tool coupled to the boom; and frame structure mounted with respect to the boom. The frame structure is separated into at least first and second adjacent compartments. Each compartment has an inlet opening and an exit opening. The method includes advancing the trenching apparatus to create a single trench with the frame structure being disposed within the trench. Filter material is fed through the inlet opening of the second compartment. A first, impermeable wall panel is inserted through the inlet opening of the first compartment. While the trenching apparatus is advancing, at least a portion of the first wall panel passes through the exit opening of the first compartment and at least some of the filter material passes through the exit opening of the second compartment in such a manner that the wall panel portion is contained within the trench between a wall of the trench and the filter material exiting the second compartment. Additional wall panels are inserted in to the frame structure and joined together to form a containment wall.

20 Claims, 4 Drawing Sheets

CONTAINMENT WALL INSTALLATION PROCESS AND APPARATUS

BACKGROUND OF THE INVENTION

The present invention relates generally to groundwater collection and containment systems, and more particularly, to a method of installing an impermeable containment wall together with filter material in a single trench, and to an apparatus for performing the method.

The need to contain, remove and treat contaminated groundwater near waste sites and landfills has increased as the amount of waste generated has increased. Conventionally, to provide a leachate collection system in conjunction with a containment wall, two separate trenches are dug utilizing a trenching machine. One trench accommodates the containment wall while the adjacent trench, typically spaced 5 to 10 feet from the first trench so as to not cause damage to the containment wall, accommodates filter material. Such a process is costly and time consuming since it requires the digging of two separate trenches. Further, since the filter material is not in close proximity to the containment wall, the collection of groundwater may not be optimal.

In constructing conventional leachate containment systems, workers may be required to work in the trench for significant amount of time during the installation process. Thus, dewatering may be required. These workers may be exposed to the hazards of contaminated soil.

SUMMARY OF THE INVENTION

Accordingly, the inventor has determined there exists a need to provide an apparatus and method for installing an impermeable containment wall together with filter material in a single trench in such a manner that workers need only enter the trench at an initial stage of installation, if at all.

It is an object of the invention to provide a method of installing a containment wall together with filter material in a single trench in a manner so as minimize the necessity for workers to enter the trench.

The foregoing and other objects are realized by providing a method of installing a groundwater containment system utilizing a powered trenching apparatus. The apparatus includes a main body portion having front and rear ends; a boom coupled to the rear end thereof; a trenching tool coupled to the boom for displacing material to define a trench; and frame structure mounted with respect to the boom rearwardly of the trenching tool. The frame structure includes opposing sidewalls defining a space therebetween. The space is separated into at least first and second adjacent compartments. The first compartment is constructed and arranged to receive one or a series of wall panels therein through an inlet opening and to permit the wall panel(s) to exit the compartment through an exit opening. The second compartment is constructed and arranged to receive filter material therein through an inlet opening and to permit the filter material to exit the second compartment through an exit opening therein.

The method includes advancing the trenching apparatus along the ground such that the trenching tool defines a single trench with the frame structure advancing within the trench as the trench is being excavated. Filter material is fed into the second compartment through the inlet opening thereof. At least one impermeable wall panel is inserted into the first compartment through the inlet opening thereof. During the advancing step, the wall panel passes through the exit opening of the first compartment and at least some of the filter material passes through the exit opening of the second compartment in such a manner that the wall panel is disposed within the trench between a wall of the trench and the filter material exiting the second compartment.

It is another object of the invention to provide a trenching apparatus for installing a groundwater containment system including a powered trenching apparatus having a main body defining front and rear ends, a boom mounted at the rear end thereof and a trenching tool coupled to the boom for displacing soil to define a trench. A frame structure is mounted to the boom generally rearwardly of the trenching tool. The frame structure includes opposing sidewalls defining a space therebetween. The space is separated into at least first and second adjacent compartments, with each compartment having an inlet opening and an exit opening. The second compartment is constructed and arranged to receive filter material therein and the first compartment is constructed and arranged to receive an impermeable wall panel therein.

The frame structure is constructed and arranged such that when at least of portion thereof is disposed in a trench and the apparatus advances, filter material and a wall panel pass through respective exit openings generally simultaneously. The wall panel exits the first compartment and is disposed within the trench between a wall of the trench and filter material exiting the second compartment.

Other objects, features and characteristics of the present invention, as well as methods of operation and functions of the related elements of the structure, and the combination of the parts and economics of manufacture, will become more apparent upon consideration of the following detailed description and appended claims with reference to the accompanying drawings, all of which form a part of this specification.

DETAILED DESCRIPTION OF THE PREFERRED EMBODIMENT

Figure 1:
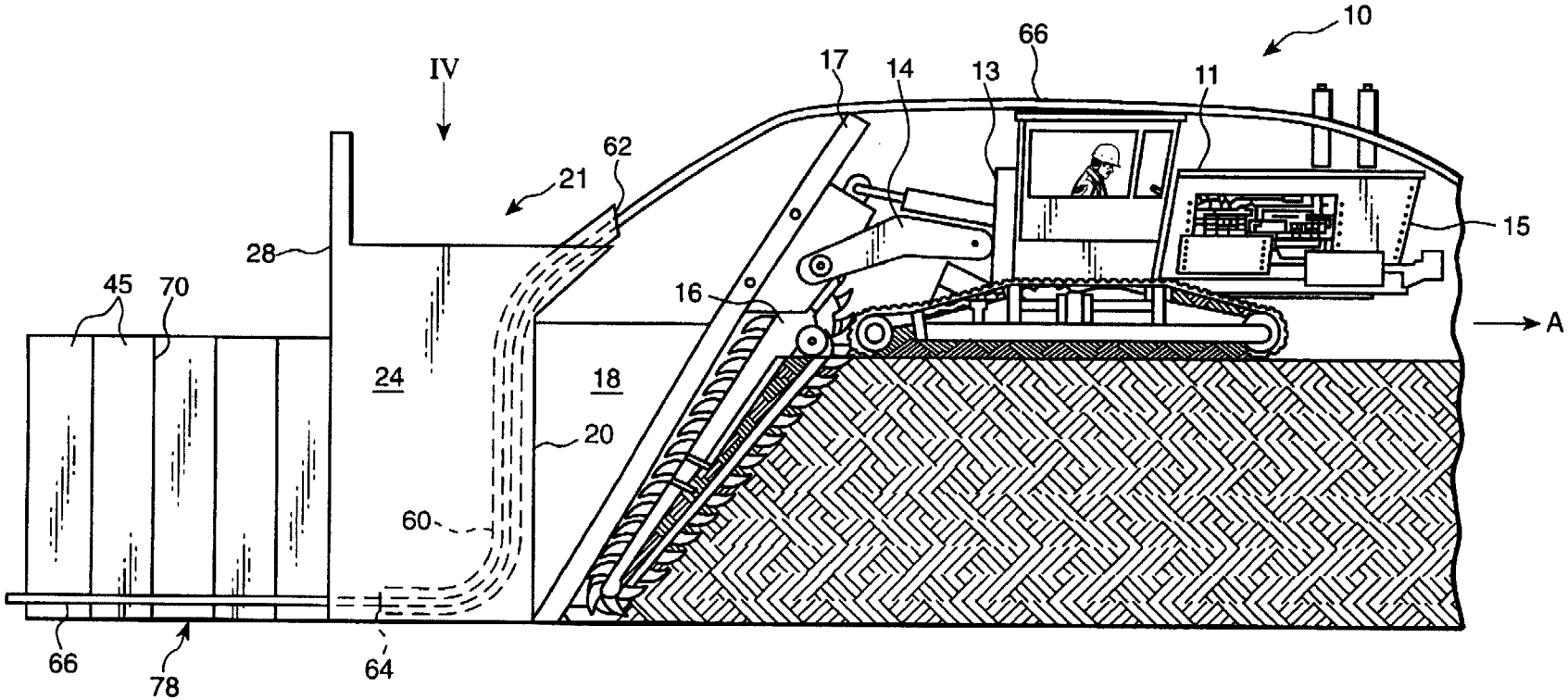
FIG. 1 is a side view of a trenching apparatus in accordance with the invention, in use installing a groundwater containment system in accordance with the invention; a side wall of the trench is removed for clarity of illustration.
Figure 2:
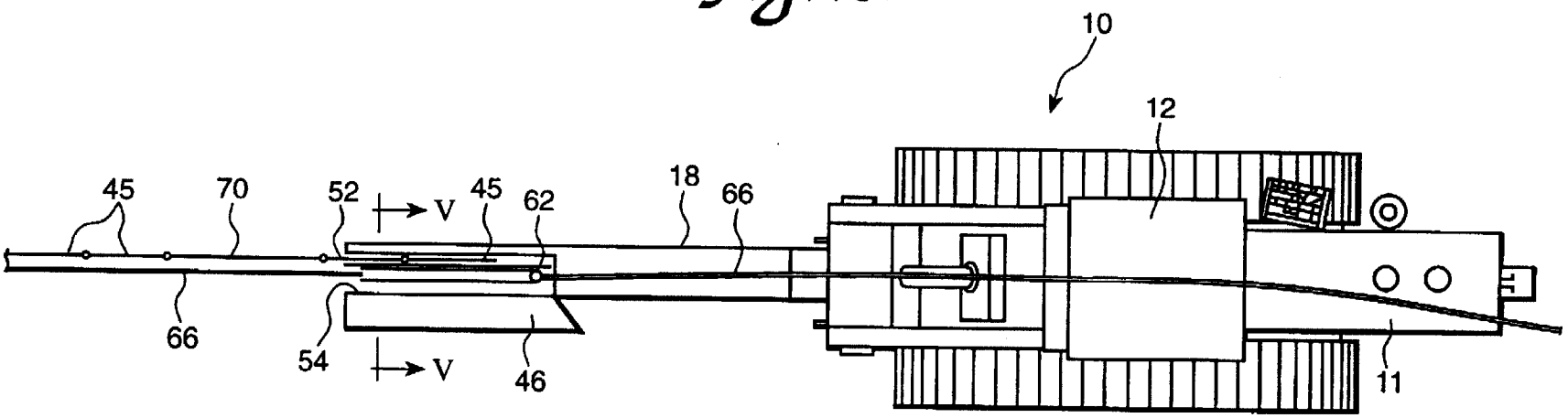
FIG. 2 is a plan view of the apparatus of FIG. 1.

Referring to the drawings, a trenching apparatus, generally indicated at 10, is shown for installing a leachate containment system which embodies the principles of the present invention.

The apparatus 10 includes a powered trenching machine 11 including a main body 12. The main body 12 defines front and rear ends 13 and 15, respectively. A boom 14 is mounted at the rear end 15 of the main body. A trenching tool 16 is coupled to the boom 14 for displacing soil to create a trench. The trenching machine 12 may be conventional. For example, the trenching machine may be a Steenbergen type trencher as disclosed in U.S. Pat. No. 4,720,212, the disclosure of which is hereby incorporated by reference into the present specification.

In the illustrated embodiment, connecting structure is provided which includes a mounting post 17 coupled to the boom 14 rearwardly of the trenching tool 16, as best shown as FIG. 1. In an operative position, the post 17 is disposed at an incline. The connecting structure also includes a wedged-shaped spacer 18 having a generally vertical end wall 20. The spacer 18 is coupled to the post 17.

In accordance with the invention, a boot or frame structure, generally indicated at 21, is coupled to the end wall 20 of the spacer 18. The spacer 18 ensures that the frame structure 21 is disposed generally vertically upright within the trench. The frame structure 21 is preferably of box-shape configuration and is constructed and arranged to receive wall panels and filter material therein such that upon movement of the trenching machine, wall panels and filter material exit the frame structure 21 and are disposed within the trench.

Figure 3:
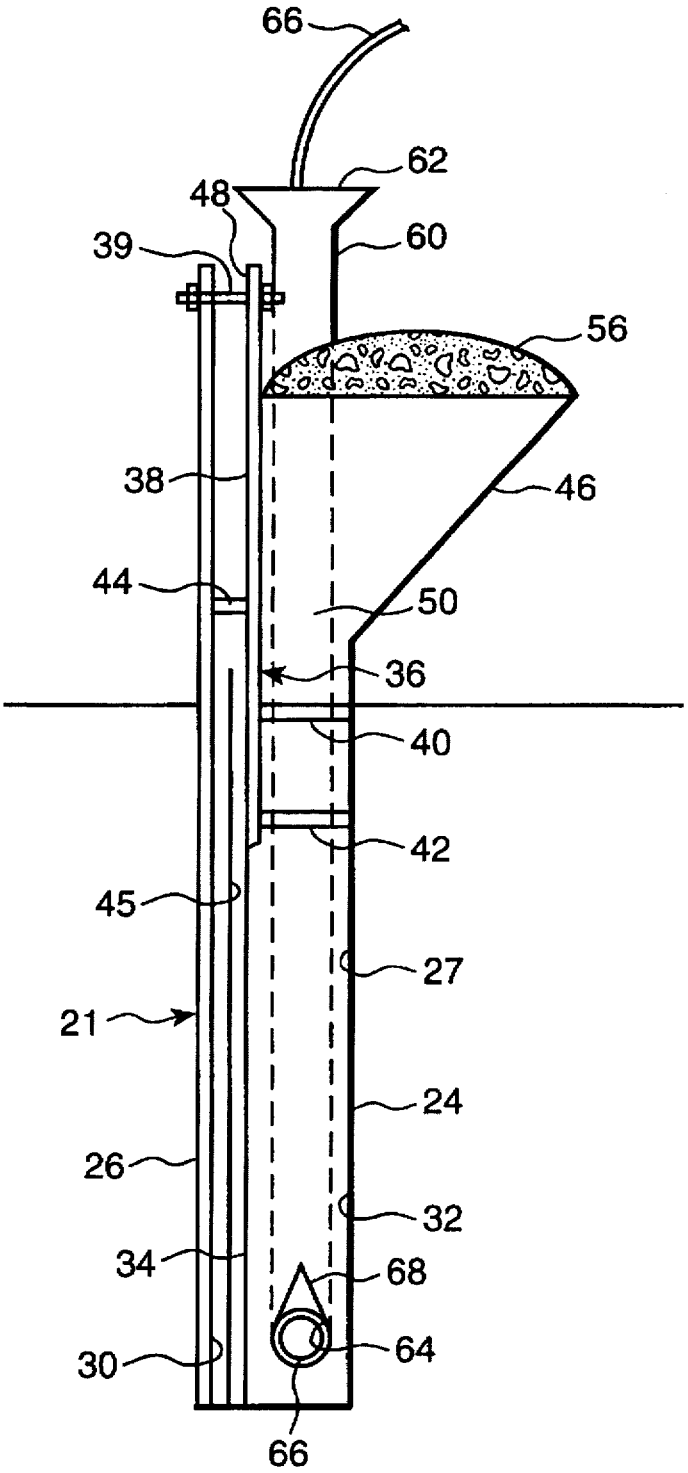
FIG. 3 is a schematic end view of the frame structure of the invention.

In the illustrated embodiment, as best shown in FIG. 3, the frame structure 21 includes opposing sidewalls 24 and 26, defining a space 27 therebetween. The sidewall 24 and 26 are of such height and width to support the walls of the trench that is being excavated. Preferably, the space 27 is separated into at least first and second compartments 30 and 32, respectively, by a wall 34. Wall 34 is a generally thin, approximately ¼" thick, steel plate.

Support structure, generally indicated at 36, is coupled to the frame structure 21 to reenforce the frame structure 21 so that ground pressure does not bow it inwardly. The illustrated embodiment, the support structure includes a generally vertical member 38 coupled by bolting 39 at an upper and thereof to the outer to the sidewall 26 of the frame structure 21. A lower end of member 38 is coupled to steel plate 34. The support structure also includes two horizontal members 40 and 42 disposed between the wall 24 and support 38. Further, a horizontal support 44 is provided between wall 26 and wall 38 so as to maintain a distance appropriate to permit a wall panel 45 to be inserted into and be removed from the frame compartment 30, as will become apparent below. The horizontal support 44 is mounted in a position so as to permit free entry of a wall panel 45 from above, into the compartment 30.

In the illustrated embodiment, each of the first and second compartments has at least one inlet opening, 48 and 50, respectively, each opening generally upwardly to receive material from above. Further, each of the first and second compartments includes at least one exit opening, 52 and 54, respectively, at the rear end portion 28 of the frame structure 21. A hopper 46 communicates with the inlet opening 50 of the second compartment 32. The hopper 46 is constructed and arranged to receive filter material 56, such as gravel, and to direct the material 56 to the second compartment 32.

Figure 5:
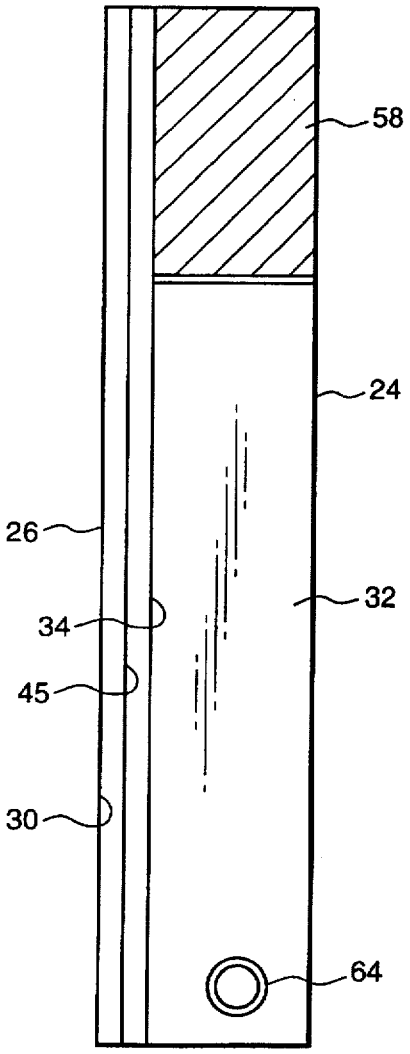
FIG. 5 is a schematic view taken along the line V—V of FIG. 2.

As shown in FIG. 5, the back portion 58 of the compartment 32 is closed-off above the height of filter material back fill elevation, to control the amount of filter material 56 that is to be provided in the trench. Thus, for example, if the first four feet of the trench are to be filled with gravel and the remaining portion with soil, the back portion 58 of the compartment 32 is closed off at the appropriate height to provide the four foot of gravel in the trench.

If perforated piping is to be delivered to the bottom of the trench, in accordance with a preferred embodiment, a hollow guide tube 60, preferably of steel, is advantageously provided and extends into the second compartment 32 of the frame structure 21. The steel tube 60 extends generally between the inlet opening 50 and the exit opening 54 of the second compartment 32. The tube 60 has first and second open ends 62 and 64, respectively. As shown in FIG. 1, one end of a perforated, high density polyethylene (HDPE) pipe 66 or other flexible, plastic pipe is inserted through the steel tube 60 and into the trench. At an initial stage of the installation process, the end of the perforated pipe 66 may be coupled to a sump (not shown) if desired. The HDPE perforated pipe 66 is delivered through tube 60 to the bottom of the trench as the trenching machine 12 moves in the direction of arrow A of FIG. 1, as will be explained in more detail below.

As shown in FIG. 3, a gravel deflector 68 is preferably provided above the lower portion of the steel tube 60 to deflect gravel or filter material 56 so that the material moves around the pipe 66.

The method of installing the containment system, according to the invention, will be appreciated with reference to the Figures. The trenching machine 12 is a self-propelled, one pass machine constructed and arranged to excavate to depths up to thirty feet and widths up to twenty-four inches. A start hole is dug and the trenching tool 16 together with the frame structure 21 is inserted into the hole. The trenching apparatus 12 is then advanced to initiate the excavation. Gravel or other filter material 56 is placed in hopper 46 and fed to directly compartment 32 of the frame structure 21 through the inlet opening 50 by any conventional means such as a wheel loader, an excavator or conveyor belt system. It can be appreciated that the gravel can be fed directly or indirectly to compartment 32 and that the hopper 46 is not required.

If HDPE perforated pipe 66 is to be incorporated into the system, it may be fed from a supply reel or other source over the top of the machine 12 and down through the steel tube 60 inside the filter material compartment 32. The perforated pipe 66 is conveyed by the combination of the movement of the trenching machine as it digs, and by the weight of the gravel placed on top of the pipe 66 as it exits the tube 60 at the exit opening 54 of compartment 32.

In the embodiment, an individual, preferably plastic panel such as an HDPE wall panel 45, is lifted into place above the frame structure 21 by means of a crane, boom truck or other apparatus capable of lifting the panel 45 to its full height above the top of the frame structure 21. The panel 45 is impermeable, generally rectangular and has a thickness generally between 60 and 100 mils. Each wall panel 45 may be, for example, a GundWall® panel manufactured by Gundle. The panel 45 is then lowered into the compartment 30 of the frame structure 21. The sidewalls 24 and 26 of the frame structure 21 support the walls of the trench. A second panel 45 may then be inserted into compartment 30 and attached by means of a known interlocking joint 70 to the previously placed wall panel 45.

Figure 4:
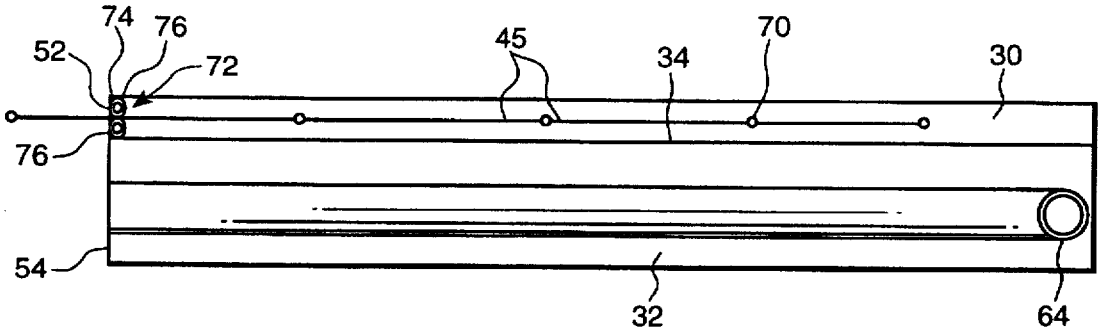
FIG. 4 is a schematic view taken as seen in the direction of arrow IV in FIG. 1.

As the trenching machine 12 advances in the direction A of FIG. 1, the panels 45 exit the frame structure through the exit opening 52 into the excavation made by the trenching machine 12. Upon exiting compartment 30 the panels 45 pass through sealing structure, which, in the illustrated embodiment, is in the form of a two-sided pneumatic seal, generally indicated at 72 (FIG. 4). The pneumatic seal 72 includes first and second seal members 74 and 76, respectively, disposed in opposing, spaced relation. Each seal member 74 and 76 is composed of generally soft rubber and has an inflatable tube 76 therein. Each tube 76 is connected to an air source (not shown) and may be inflated and deflated accordingly so as to control a contact force with the wall panel thereby permitting the thin panel 45 and larger interlocking joint 70 to exit the compartment 30 and thus the frame structure 21. The pneumatic seal 72 prevents soils from the excavation from invading the compartment 30 via the exit opening 52. Other sealing structure is within the contemplation of the invention, such as, for example, spaced elastic members constructed and arranged to permit the wall structure to pass therethrough, yet having sufficient rigidity to prevent soils from entering the compartment 30.

As each panel 45 exits the frame structure 21, it is immediately sandwiched by a side wall of the trench and by the filter material 56 exiting the adjacent compartment 32 of the frame structure 21.

Figure 6:
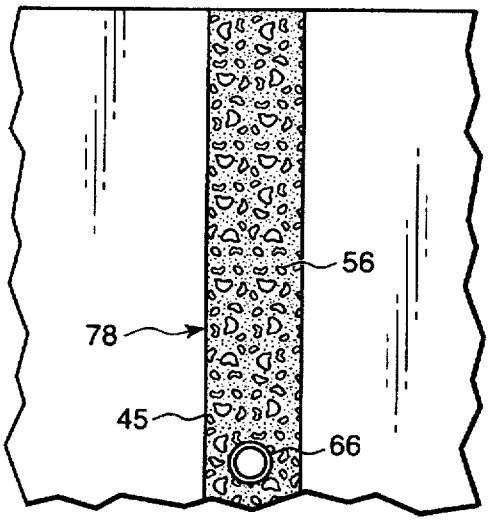
FIG. 6 is an end view of a trench having a vertical containment wall and filter material therein.

It can be appreciated that the length of a wall structure 78 to be constructed may controlled by the number of wall panels 45 installed. A completed wall structure 78 is shown contained within the trench by the filter material 56 in FIG. 6.

If an obstruction is encountered during the excavation, the post 17 may be removed from the boom 14. Thus, the post 17, spacer 18 and frame structure 21 can remain in the trench while the obstruction is removed.

The combination of filter material 56, containment wall structure 78 and collection pipe 66 in the same trench allows for the containment and the collection of contaminants from the groundwater.

The installed system prevents infiltration of uncontaminated groundwater, on the down gradient side of the wall structure 78, into the contaminated areas on the other side (upgradient) of the wall structure during pumping operations on either side of the wall structure.

It can be appreciated that the system and apparatus of the invention reduces the cost and time of installing a leachate containment wall system. Cost and installation time are reduced since the apparatus digs a narrow trench, supports the sidewalls, delivers vertical wall panels to the trench, lays perforated pipe and supplies gravel to the trench all in the same pass. Thus, the single trench can be used in place of a separate trench and slurry wall for groundwater collection and containment. Further, the need for dewatering is eliminated since all workers remain above grade once the trenching is initiated.

While the invention has been described in connection with what its presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. A method for installing a groundwater containment system utilizing a powered trenching apparatus, the apparatus having a main body defining front and rear ends; a boom coupled to the rear end thereof; a trenching tool coupled to the boom for displacing soil to define a trench; frame structure mounted with respect to the boom rearwardly of the trenching tool, said frame structure including opposing sidewalls defining a space therebetween, said space being separated into at least first and second adjacent compartments, each said compartment having an inlet opening and an exit opening, the method comprising the steps of:

advancing the trenching apparatus along the ground such that the trenching tool creates a single trench, with said frame structure advancing within the trench as the trench is being excavated, feeding filter material into said second compartment through the inlet opening thereof, inserting at least one impermeable wall panel into said first compartment through the inlet opening thereof, wherein during the advancing step, said at least one wall panel passes through the exit opening of the first compartment and at least some of the filter material passes through the exit opening of the second compartment in such a manner that said at least one wall panel is disposed within the trench between a wall of the trench and filter material exiting said second compartment.

2. The method according to claim 1, further comprising inserting a second, impermeable wall panel through the inlet opening of the first compartment and into said first compartment and coupling said second wall panel to said one wall panel to form a containment wall structure.

3. The method according to claim 2, further comprising feeding a perforated pipe into said second compartment, the perforated pipe exiting the exit opening of the second compartment together with the filter material in such a manner that the filter material covers the perforated pipe near a bottom of the trench adjacent the containment wall structure.

4. The method according to claim 3, wherein a hollow tube is disposed within the second compartment, said tube being constructed and arranged and to permit the perforated pipe to pass therethrough and be fed generally along a bottom of the trench.

5. The method according to claim 2, wherein said wall panels are inserted generally vertically into the inlet opening of the first compartment.

6. A trenching system for installing a groundwater containment system, the trenching system comprising:

a powered trenching apparatus having a main body defining front ad rear ends, a boom mounted at the rear end and a trenching tool coupled to the boom for displacing soil to define a trench, and frame structure mounted to said boom generally rearwardly of said trenching tool, said frame structure including opposing sidewalls constructed and arranged to be disposed substantially within the trench, said sidewalls defining a space therebetween, said space being separated into at least first and second adjacent compartments, each said compartment having an inlet opening and an exit opening, said second compartment being constructed and arranged to receive filter material therein, said first compartment being constructed and arranged to receive an impermeable wall panel therein, said frame structure being constructed and arranged such that upon advancement of said apparatus, filter material and a wall panel may pass through said respective exit openings generally simultaneously such that a wall panel exiting said first compartment is disposed within the trench between a wall of the trench and filter material exiting said second compartment.

7. The system according to claim 6, further comprising a hollow tube extending generally between said inlet opening and said exit opening of said second compartment, said tube having first and second opened ends.

8. The system according to claim 7, in combination with filter material in said second compartment, a perforated pipe in said tube and a wall panel in said first compartment, wherein said frame structure is constructed and arranged so that as said apparatus is advanced, at least a portion of said perforated pipe together with the filter material pass though the exit opening in the second compartment while said wall panel passes through the exit opening of said first compartment with the filter material (1) covering the perforated pipe near a bottom of the trench and (2) stably containing the wall panel within the trench.

9. The system according to claim 8, wherein said second compartment includes a deflector for guiding the filter material around said perforated pipe.

10. The system according to claim 6, wherein said first compartment includes sealing structure at the exit opening of said first compartment, said sealing structure being constructed and arranged to permit a wall panel to pass through said first compartment exit opening while preventing excavation soils from entering said first compartment exit opening.

11. The system according to claim 8, wherein said first compartment includes sealing structure at said first compartment exit opening, said sealing structure being constructed and arranged to permit said wall panel to pass through said first compartment exit opening while preventing excavation soils from entering said first compartment exit opening.

12. The system according to claim 11, wherein said sealing structure includes first and second seal members disposed at said first compartment exit opening, said seal members being in spaced relation, with said wall panel being oriented within the first compartment so as to pass between said seal members, each seal member being pneumatically operated such that inflation and deflation of said seal members controls a force of contact of the seal members with said wall panel.

13. The system according to claim 6, wherein said frame structure includes reinforcing structure constructed and arranged to reinforce the sidewalls against ground pressure.

14. The system according to claim 6, wherein said trenching apparatus includes connecting structure for removably coupling said frame structure to said boom.

15. The system according to claim 14, wherein said connecting structure includes a post removably coupled to the boom and a spacer coupled between said post and said frame structure, said spacer being constructed and arranged so as to ensure that the frame structure is disposed generally vertically upright within the trench.

16. The system according to claim 6, wherein said frame structure includes a hopper for guiding filter material into the second compartment.

17. The system according to claim 6, wherein said second compartment is constructed and arranged to permit a selected amount of filter material to pass through said second compartment exit opening.

18. The system according to claim 8, wherein said wall panel is composed of high density polyethylene, is generally rectangular and has a thickness in the range of 60 to 100 mils.

19. The system according to claim 8, wherein said filter material is gravel.

20. The system according to claim 8, wherein said perforated pipe is composed of high density polyethylene.

* * * * *